US008276915B2

(12) United States Patent
Berkowitz et al.

(10) Patent No.: US 8,276,915 B2
(45) Date of Patent: Oct. 2, 2012

(54) GAME APPARATUS AND METHOD

(75) Inventors: Norman G. Berkowitz, Slatington, PA (US); G. Gordon Evans, Slatington, PA (US)

(73) Assignee: Markman Holdings, LLC, Las Vegas, NV (US)

( * ) Notice: Subject to any disclaimer, the term of this patent is extended or adjusted under 35 U.S.C. 154(b) by 734 days.

(21) Appl. No.: 11/983,575

(22) Filed: Nov. 9, 2007

(65) Prior Publication Data

US 2009/0121427 A1 May 14, 2009

(51) Int. Cl.
*A63F 9/04* (2006.01)

(52) U.S. Cl. ..... 273/146

(58) Field of Classification Search ..... 273/146, 273/274; 463/10, 12, 13
See application file for complete search history.

(56) References Cited

U.S. PATENT DOCUMENTS

| | | | | | |
|---|---|---|---|---|---|
| 2,560,187 | A | * | 7/1951 | Post | 273/146 |
| 2,861,809 | A | * | 11/1958 | Fischl | 273/141 R |
| 3,614,105 | A | * | 10/1971 | Dandini | 273/146 |
| 4,346,900 | A | | 8/1982 | Lamlee | |
| 4,469,329 | A | * | 9/1984 | Guyer | 273/146 |
| 4,648,602 | A | * | 3/1987 | Maroney | 273/146 |
| 4,834,386 | A | * | 5/1989 | Rosenthal et al. | 273/146 |
| 4,893,816 | A | * | 1/1990 | Levy et al. | 273/146 |
| 4,930,780 | A | * | 6/1990 | Goodman et al. | 273/146 |
| 4,936,588 | A | * | 6/1990 | Rader et al. | 273/243 |
| 5,050,888 | A | * | 9/1991 | Schultz et al. | 273/248 |
| 5,125,660 | A | * | 6/1992 | Stahl | 273/146 |
| 5,346,101 | A | * | 9/1994 | Hargis et al. | 222/195 |
| 5,388,830 | A | * | 2/1995 | Dixson | 273/146 |
| 5,405,145 | A | * | 4/1995 | Jones et al. | 273/146 |
| 5,456,467 | A | * | 10/1995 | Hoover | 273/146 |
| 5,605,331 | A | * | 2/1997 | Boe | 273/146 |
| 5,649,704 | A | * | 7/1997 | Dobbin | 273/268 |
| 5,879,006 | A | | 3/1999 | Bowling | |
| 6,102,400 | A | * | 8/2000 | Scott et al. | 273/269 |
| 6,273,423 | B1 | | 8/2001 | Promutico | |
| 6,299,166 | B1 | * | 10/2001 | Factor | 273/146 |
| 6,508,469 | B2 | | 1/2003 | Promutico | |
| 6,543,768 | B1 | * | 4/2003 | Kuzel | 273/146 |
| 6,565,088 | B2 | * | 5/2003 | Perrie et al. | 273/146 |
| 6,605,001 | B1 | | 8/2003 | Tarantino | |
| D482,735 | S | | 11/2003 | Evans | |
| 6,659,868 | B2 | * | 12/2003 | Stern | 463/20 |

(Continued)

*Primary Examiner* — William Pierce
(74) *Attorney, Agent, or Firm* — Charles A. Wilkinson; Clinton H. Wilkinson

(57) ABSTRACT

A dice game and method of playing a dice game is disclosed wherein provided are ten dice, a dice box having a score pad and bonus card holding area, playing chips and chip holders, a score payout card, and instructions for playing the game. Players take turns rolling the ten dice in the dice box, and if three like kind or more dice of the same suit are rolled, such dice are placed on the score pad and removed from play, after which the player must decide whether to reroll the remaining dice or bank the point from the initial roll. If on a subsequent roll in a turn a dice of the same suit is not rolled, the players turn is over and all points accumulated in such turn are lost. If three like kind or more dice are not rolled on an initial roll, the player selects a "bonus" card and is awarded the designated number of points on the card, and the dice are rolled again. After a play becomes the "winner" by being the first to achieve 122,000 points, each other play will have a final turn in which to attempt to achieve an even higher score, with the player achieving the highest score becoming the "high roll winner".

5 Claims, 7 Drawing Sheets

U.S. PATENT DOCUMENTS

| | | | | |
|---|---|---|---|---|
| 6,729,619 | B2 * | 5/2004 | Yu et al. | 273/146 |
| 6,746,016 | B2 * | 6/2004 | Perrie et al. | 273/138.1 |
| 7,032,901 | B2 * | 4/2006 | Perrie et al. | 273/138.1 |
| 7,252,289 | B2 * | 8/2007 | Tamian | 273/146 |
| 7,334,792 | B1 * | 2/2008 | Bermann | 273/146 |
| 7,494,124 | B2 * | 2/2009 | Hole | 273/146 |
| 7,810,813 | B2 * | 10/2010 | Denoual | 273/146 |
| 2002/0036380 | A1 * | 3/2002 | Perrie et al. | 273/146 |
| 2002/0160827 | A1 | 10/2002 | Slomiany et al. | |
| 2003/0062672 | A1 * | 4/2003 | Sloper | 273/146 |
| 2003/0075864 | A1 | 4/2003 | Swavy et al. | |
| 2003/0155708 | A1 * | 8/2003 | Perrie et al. | 273/138.1 |
| 2003/0218300 | A1 | 11/2003 | Timmons, Sr. | |
| 2005/0046107 | A1 * | 3/2005 | Guyer et al. | 273/146 |
| 2005/0082757 | A1 | 4/2005 | Cohen | |
| 2005/0093229 | A1 * | 5/2005 | Dewayne et al. | 273/146 |
| 2005/0156380 | A1 | 7/2005 | Warthen | |
| 2008/0203657 | A1 * | 8/2008 | Hole | 273/146 |

* cited by examiner

28

34

Game Rules & Instructions

Player: 2 to 5
Ages: 12 to Adult

Game Contents:

| | |
|---|---|
| 10 | Custom Dice |
| 1 | Throw Box |
| 1 | Banker Chip Tray |
| 4 | Player Chip Racks |
| 22 | Bonus Cards |
| 170 | Yellow (100) Chips |
| 85 | Orange (1000) Chips |
| 85 | Turquoise (5000) Chips |
| 1 | Dice Score Payout Card |

Before playing for the first time, check game contents and apply decals to the game pieces according to the instructions.

GAME APPARATUS AND METHOD

BACKGROUND OF THE INVENTION

1. Field of the Invention

The present invention relates to dice games and games of chance in general, and more particularly to an entertaining board game and method of play using a plurality of dice in which if upon an initial roll or throw in a player's turn a predetermined result is not achieved, such player may accumulate points through a separate bonus scoring mechanism so that at least some points are accumulated in every turn, and wherein after one player has achieved a predetermined winning number of points, each remaining player has a final turn to try to achieve an even higher point total and become the high roll winner.

2. Description of Related Art

Dice games and games of chance are of course well known in the prior art. In the method of play of most of such games, several six-sided cubical dice are thrown or rolled simultaneously, with the result being either positive or negative as dictated by the particular rules of such games. The use of dice boxes in which such dice are thrown is also a known concept. The following prior art references are illustrative of the closest prior art games known to the present inventor.

U.S. Pat. No. 4,930,780 issued to V. R. Goodman et al. on Jun. 5, 1990, entitled "Dice Game", discloses a dice game comprised primarily of a throwing box having two compartments, six dice, and a tally sheet. In the method of play of such game, all six dice are rolled together in the first compartment, and then scoring dice are removed and placed in the second compartment, after which the remaining dice are rolled again. In order for points to be counted, a player must voluntarily stop rolling while he or she is scoring points or winning. In addition, in order to start accumulating points in the game, players must achieve a certain point value in a roll. Unlike the present inventor's game, the Goodman et al. game does not use chips, does not require three like kind or more of the same suit to be rolled in an initial roll, and does not utilize "Bonus" cards when three like kind or more of the same suit in an initial roll is not rolled.

U.S. Pat. No. 5,456,467 issued to B. L. Hoover on Oct. 10, 1995, entitled "Method of Playing a Poker Dice Game", discloses a dice game wherein five dice are rolled and for one's turn to continue the result must include at least one dice with the number one or the number five showing, three dice with the same number showing, or all five dice having the same number showing. While certain of the dice may be re-rolled, the Hoover method of play is overall unlike that of the present inventor.

U.S. Pat. No. 5,649,704 issued to T. L. Dobbin on Jul. 22, 1997, entitled "Dice Game Method," discloses a dice game comprised of six die plus a bonus die and a position die for determining order of play. The six die are rolled together, and point values are designated to each die and combinations of outcomes, with the first player to accumulate 10,000 points or roll six-of-a-kind being declared the winner. In addition, after 650 points have been accumulated in a turn, a "dare" may be optionally selected and the "bonus" die thrown to double or triple the player's roll. While the Dobbin dice game includes a "bonus" system as part of the method, overall such method is unlike that of the present inventor's game, wherein if three like kind dice or more are not thrown on an initial roll, the player is automatically awarded a "bonus" card plus an opportunity to roll all ten dice again.

U.S. Pat. No. 6,273,423 issued to R. R. Promutico on Aug. 14, 2002, entitled "Game of Chance Using Six Dice," discloses a dice game wherein poker-like outcomes (two of a kind, two pairs, etc.) are available, and a second set of dice to double or triple a score is available. Promutico uses two visually distinguishable sets of three dice, rather than ten dice as in the present invention. The Promutico game is also an example of a betting game, wherein unlike the present inventor's game system and method bets are placed before the die are thrown.

U.S. Pat. No. 6,299,166 issued to E. Factor on Oct. 9, 2001, entitled "Method and Apparatus for Playing a Dice Game," discloses a game named Olé that utilizes a pair of dice and scoring chips and wherein players start with a maximum score and points are deducted from such score based on the statistical ranking of the possible outcomes of the rolls of the players. As an example, for two dice, there are twenty-one possible outcomes, which are ranked from one to twenty-one; the player with the lowest ranking throw based on such rankings must deduct score points. The last player to have any points left is declared the winner. Such method is play is unlike that of the present invention.

U.S. Pat. No. 6,543,768 issued to M. R. Kuzel on Apr. 8, 2003, entitled "Dice Game", discloses a method of playing a dice game wherein initially a player must qualify to be "on the board" before positive points can be accumulated, requiring a roll of 500 points or more. If a player does not roll a 1, 5, three-of-a-kind, four-of-a-kind, or long straight, a BOGUS is declared and points are deducted, including the time before the player is "on the board", so that a player may have a negative point total. During play, in general, on the first roll, five dice are rolled, on the second roll four dice are rolled, on the third roll three dice are rolled, on the fourth roll two dice are rolled, and on the fifth roll only a single dice is rolled, although as soon as a dice with a specified value is not rolled, the player's turn is over. Also, once a player has achieved a winning point total, other of the players that have achieved a certain value are granted a final roll. While somewhat similar in some aspects to the present inventor's game, the overall method of the present game is neither disclosed nor anticipated.

U.S. Pat. Pub. No. 2003/0075864 issued to C. Swavy et al. on Apr. 24, 2003, entitled "Method of Playing a Three Dice Game," discloses a three-dice game including dice, a game board, with two players and a banker, wherein certain rolls are an automatic win and an automatic loss, respectively. Bets can be placed by other players as to what the next roll will be, which may be an automatic winner, an automatic loser, or a point. Swavy et al. is thus representative of the multitude of betting type dice games known in the prior art.

U.S. Pat. Pub. No. 2003/0218300 issued to W. P. Timmons, Sr. on Nov. 27, 2003, entitled "Dice Game", discloses a dice game wherein there may be a winner for every roll of the dice. The game may played with 3, 4, or 5 dice, plus a game table wherein the pay out odds for all of the roll combinations are shown, with odds of up to 6000 to 1 in a five dice game.

U.S. Pat. Pub. No 2005/0082757 issued to J. B. Cohen on Apr. 21, 2005, entitled "Method and Apparatus for a Dice Game," discloses a dice game including a game board with the number 11-66 printed around the periphery of the board, and a pair of dice, wherein one die has values of 1-6, while the other has values of 1-6 TIMES TEN. A target number and points above or below the target number are selected, and then bets on the first or second point are taken, with the winner being dependent upon the outcome of the roll.

U.S. Pat. Pub. No 2005/0156380 issued to C. Warthen on Jul. 21, 2005, entitled "Game System and Method for Playing a Game," discloses a board game which utilizes a combination of dice, chips, and playing cards. The goal of the game is to achieve "whale status", a high gambling status for certain casinos. Warthen's method of play is unlike that of the present invention.

While these known games are each entertaining in their own way and are presumably suitable for their particular purposes, such games are each different from the present inventor's game system and method of play, wherein in a preferred embodiment a player upon an initial roll of ten dice together must achieve three like kind or more of the same suit. In addition, if this result is not achieved, the player's turn is not over but he or she may then select a card from a deck of "Bonus" cards, and is automatically awarded the bonus points indicated on the card. In addition, the player then may re-roll the ten dice and try again to achieve three like kind or more of the same suit, which if achieved the three like kind or more dice are placed in a separate holding area, and the player may elect either to bank the points awarded for such throw, ending the turn, or throw the remaining dice again in an attempt to accumulate more points by throwing one or more additional dice with the same number facing upwardly as those in the separate holding area. Furthermore, while a goal of the game is to be the first player to accumulate a total of 122,000 points, when achieved the remaining players will each have one final turn to try to accumulate an even greater number of points, with the player that accumulates the greatest number of points being declared the "high roll winner". It is believed that such method and the corresponding game apparatus provide a highly entertaining, strategic, and fast-paced game which incorporates a unique blend of chance, strategy, and skill.

OBJECTS OF THE INVENTION

It is therefore a primary object of the present invention to provide a fast-paced and exciting game apparatus and method of play having a unique blend of chance, strategy, and skill and which can be enjoyed by players of all ages.

It is a further object of the present invention to provide a game apparatus and method of play wherein in a preferred embodiment two or more players take turns throwing ten dice simultaneously, and if upon an initial roll of such ten dice any three like kind or more of the same suit results, the group of dice of the same suit having the highest value is placed face up on a score pad, after which the player may either "bank" the point value associated with these dice by collecting a corresponding number of chips from the banker, thereby ending such player's turn, or elect to re-roll the remaining dice not placed on the score pad one or more additional times in an attempt to roll more dice of the same suit and further increase the total score for such turn, but if a subsequent roll does not result in at least one dice of the same suit, such player's turn is ended and no points are awarded for such turn.

It is a still further object of the present invention to provide a game apparatus and method of play of a dice game wherein in a preferred embodiment if upon a roll of ten dice three like kind or more dice of the same suit are not achieved, the player then must select a card from a deck of "Bonus" cards and is awarded the point total indicated on the card, and then must roll the ten dice again, which steps are repeated until at least one set of three like kind or more of same suit dice is rolled.

It is a still further object of the present invention to provide a game apparatus and method of play of a dice game wherein the first roll of each players turn in all cases results in a potential award of at least some points or chips, and each player will have the opportunity for at least two throws of the dice per turn.

It is a still further object of the invention to provide a game apparatus and method of play of a dice game wherein the "winner' of the game is the first player to accumulate and exceed a predetermined number of points or chips; however, once the "winner" has been determined, the other players will have one last turn in which they attempt to achieve a higher point total than the "winner", with the player achieving the highest overall point total being declared the overall or "high roll" winner.

Still other objects and advantages of the invention will become clear upon review of the following detailed description in conjunction with the appended drawings.

SUMMARY OF THE INVENTION

The foregoing objects are attained in the present invention by providing a strategic game apparatus and method of play of a dice game using multiple dice which is played in measured steps by multiple players who accumulate points beginning with the throwing of ten dice in an effort to roll three like kind or more scoring dice of the same suit, which determines the dice number to be used by the player and initiates the players score after which the scoring dice are removed temporarily from play. Thereafter, each player may elect to re-roll the remaining dice, and if one or more of the re-rolled dice has the same suit as the scoring dice previously removed from play, the players accumulated score for that turn is again raised based on such additional number. In the event no dice of the same suit is thrown in later rolls, however, the player loses the score accumulated on previous rolls in the same turn. However, after each player has rolled three of a kind on an initial roll or achieved at least one dice of the same suit in a later roll, such player may decide to forego any further rolls and "bank" the points accumulated in such turn, which points are added to their total score. If no three of a kind or more dice are rolled on an initial roll, the player then must draw a bonus card from a shuffled pack of bonus cards providing a bonus, after which the player again rolls all of the dice. The first player to achieves a preset score is declared the winner; however, each other player will have a final chance to try to achieve an even higher score than the winning score, and the player with the highest score is declared the "high roll" winner. The strategy of the game lies in calculation of the progress of other players toward a winning score and adjusting ones rolls to take advantage of the greater chance of building up a score near the beginning of any series of play than near the end. Larger scoring numbers may be added to the players score as their number of consecutive turns increases.

DESCRIPTION OF THE PREFERRED EMBODIMENTS

Figure 1:
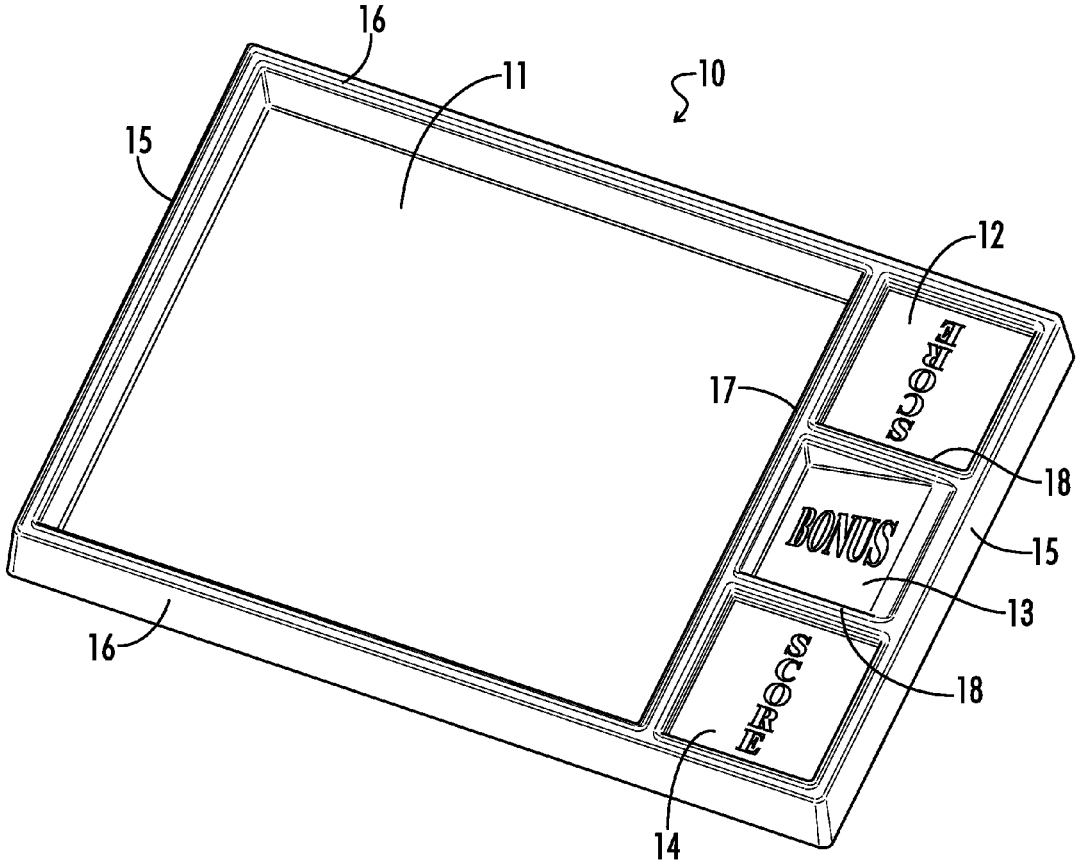
FIG. 1 is a perspective view of the dice throw box used in the preferred embodiment of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

The present invention is directed to a unique game system and method of play of a game designed to be played by two or more players in which described broadly although the ultimate goal of each player is to achieve the highest score or a predetermined point total, value, or worth, and thus to be declared the winner, the goal of each player upon commencing his or her turn is, utilizing an appropriate chance determining mechanism, to achieve a predetermined minimum number of occurrences of a symbol, suit, marking, number, representation, or the like out of a maximum total number of possible occurrences. If such minimum number of occurrences is achieved, which number will correspond to a certain point value or worth, the player has the choice of accepting or being satisfied with the value or worth accumulated for that turn, voluntarily banking such value or worth, and giving up the opportunity to try to accumulate additional value or worth on that turn, whereupon it becomes the next players turn. Alternatively, such player can elect to attempt to accumulate additional points, value or worth in that turn by utilizing the chance determining means a second time in an attempt to generate one or more additional occurrences of the same symbol, marking, number, representation, or the like, less the number of occurrences already achieved. Upon utilizing the chance determining means a second time, however, the player risks losing all of the value or worth already accumulated in such turn if at least one additional instance of the same occurrence is not achieved. The odds of achieving the same occurrence of a symbol, number or the like while utilizing the chance determining means a second time are reduced in proportion to the number of occurrences achieved in the first use; however, the reward for achieving at least one instance of the same occurrence is proportionately increased. In other words, if the same occurrence or multiple occurrences of the same symbol are achieved upon such second use of the chance determining means, the player will accumulate a correspondingly greater value or worth, although the risk of failure also increases. Such player can then either be satisfied with this additional level of accumulated value or worth and end his or her turn voluntarily, at which point it becomes the next players turn, or the player can utilize the chance mechanism one or more additional times to try to accumulate even greater value of worth, but with an even lesser chance of success each time.

In addition, while in the present game system and method of play the goal of each player initially is to achieve, utilizing a chance determining means, a predetermined minimum number of occurrences of the same symbol, suit, marking, number, representation, or the like out of a maximum total number of possible occurrences, when such result is not achieved upon an initial roll in a turn, the players turn is not over, as it would be in the prior art games known to the present inventor. Rather, such player then receives an award of points or value through an alternate chance determining means or game mechanism, such as a deck of bonus cards, which award preferably will be on average substantial in nature in comparison to the usual value or worth available from a single turn with the first chance determining means. In addition, after receiving such award, which may or may not be generated randomly, the player is also preferably given another opportunity in the same turn to utilize the first chance determining mechanism to try to accumulate even more value or worth. Thus, unlike prior art game systems and methods known to the inventor, in the present system and method, even when a player does not achieve his or her goal upon an initial use of a chance determining means, such player not only is automatically rewarded through a separate award mechanism or system, but in addition such player then is availed another opportunity to achieve such goal using the first chance determining means, so that in effect the player is in all cases rewarded through either of such reward mechanisms.

In addition to the present inventor's unique system and method for accumulating points in a game, another aspect of the presently described system and method is an atypical manner of determining the "overall winner" of such game. As indicated above, the ultimate goal of the game is to achieve or accumulate the most points or value during game play, wherein upon achieving a predetermined point total or worth a player will be declared the "winner". However, in the present game system and method, even after a player has been declared the "winner", the remaining players will still have one last chance to try to achieve an even higher point total or value than was achieved by the winner, therefore possibly becoming the "overall winner". The several methods of generating or accumulating points or value in the game and the risk/reward relationship associated with such methods, in combination with the different ways of winning the game, overall creates a fast paced and exciting game wherein the strategies used by the players are likely to change throughout the game or even with each turn. It is also preferred that each player be to discern at least generally the value or worth that has been accumulated by each other player in the game at any time, which will further effect the strategy of the players at any time during the game depending upon a players position in relation to the other players. The strategy of each player will be even further variable depending upon that player's perception of the odds colored by the player's own mental set as colored by personality traits and experience.

While such game system and method is described below with reference to play of a dice box or board game, the present inventor has contemplated that such basic game system and method as described above can be applied in a variety of different game types and environments, including but not limited to casino games such as slot machine games, table games, and wheel play games, electronic games including portable electronic games, video games, online and Internet games, and the like.

A preferred board game arrangement incorporating the system and method discussed above in general terms will now be described, with particular reference being made to FIGS. 1-8. FIG. 1 illustrates a dice throw box 10 having a larger first section 11, and situated along one side three smaller sections 12, 13, and 14. Each of the sections of throw box 10 is generally rectangular in shape and defined by vertical end walls 15 and vertical side walls 16, a vertical partition 17 separating first section 11 from the smaller sections 12, 13, and 14, and partitions 18 separating said three smaller sections 12-14. The floor of larger section 11, which serves as a bay for catching dice when thrown in the box, is preferably covered with a cushioning material such as felt or other suitable material to cushion the impact of the dice. Sections 12-14 may also be felt-lined, with sections 12 and 14 serving as score pads on which during play of the game certain of the dice that are temporarily removed from the game to be counted in scoring are placed, as will be explained below, and with middle section 13 being sized to accommodate a deck of "bonus" cards used in the game and preferably having an inwardly sloped or angled floor. In one arrangement, box 10 has a width of 9 inches, a length of 12.5 inches, and a height of 1.25 inches, while larger section 11 has a width of 8.25 inches, a length of 9.5 inches, and a wall height of 1 inch, sections 12 and 14 have a width of 2.5 inches and a length of 2.25 inches, and section 13 has a width of 2 inches and a length of 2.25 inches. Box 10 can be made of any suitable material such as wood, plastic, metal, or the like.

Figure 2:
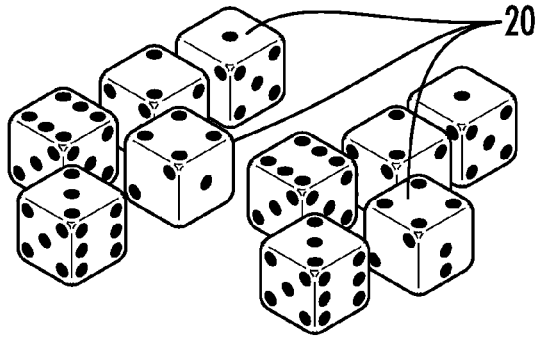
FIG. 2 is a perspective view of ten six-sided dice for use with the game apparatus and method of the invention.
Figure 3:
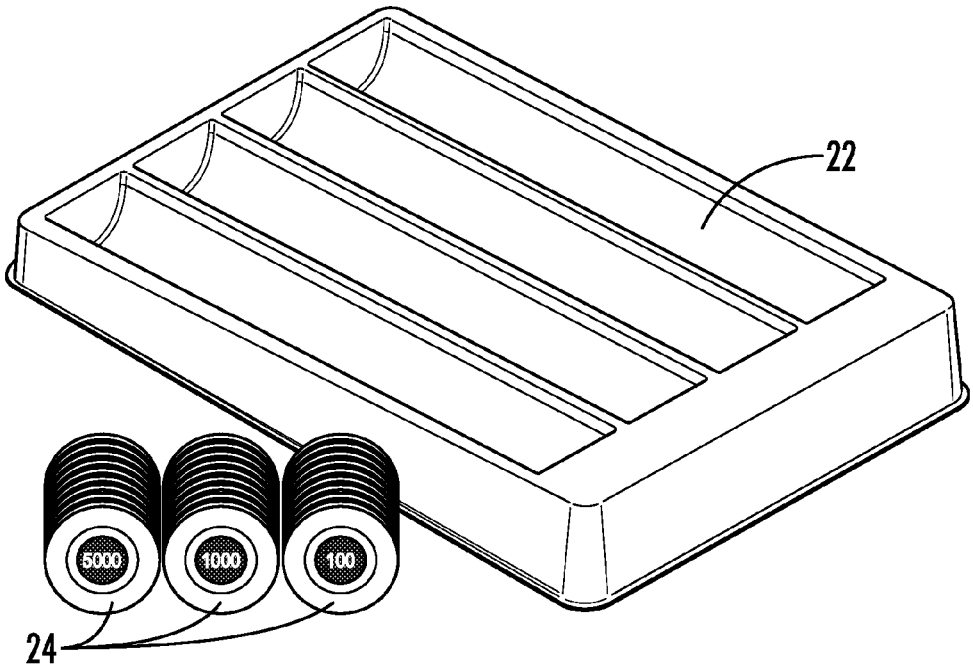
FIG. 3 is a perspective view of a chip box or tray comprising part of the game apparatus of the present invention.
Figure 4:
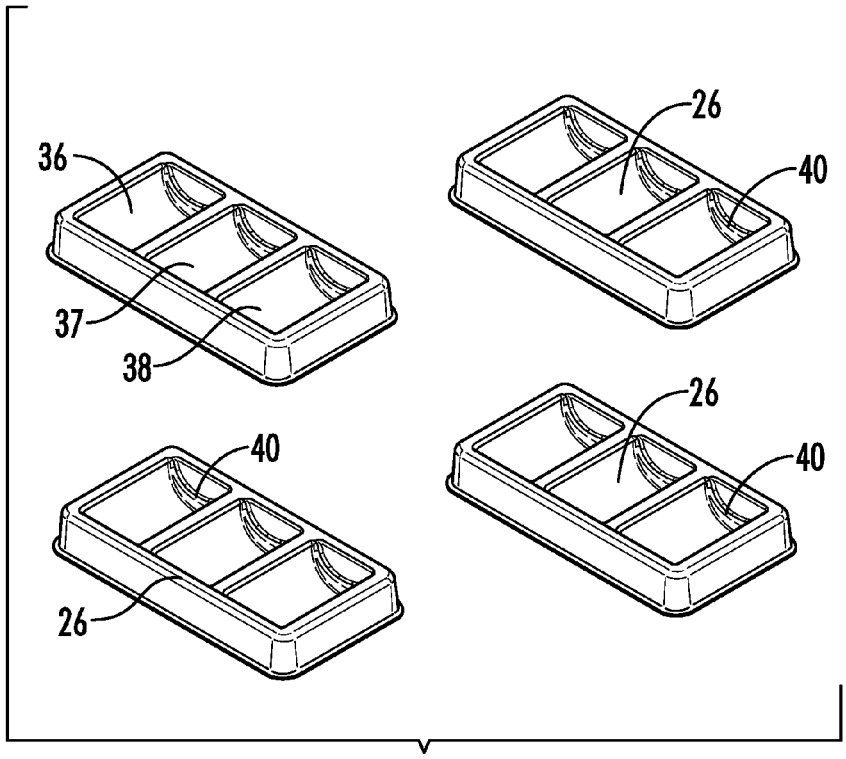
FIG. 4 is a perspective view of several playing chip holders used with the game apparatus of the present invention.
Figure 5:
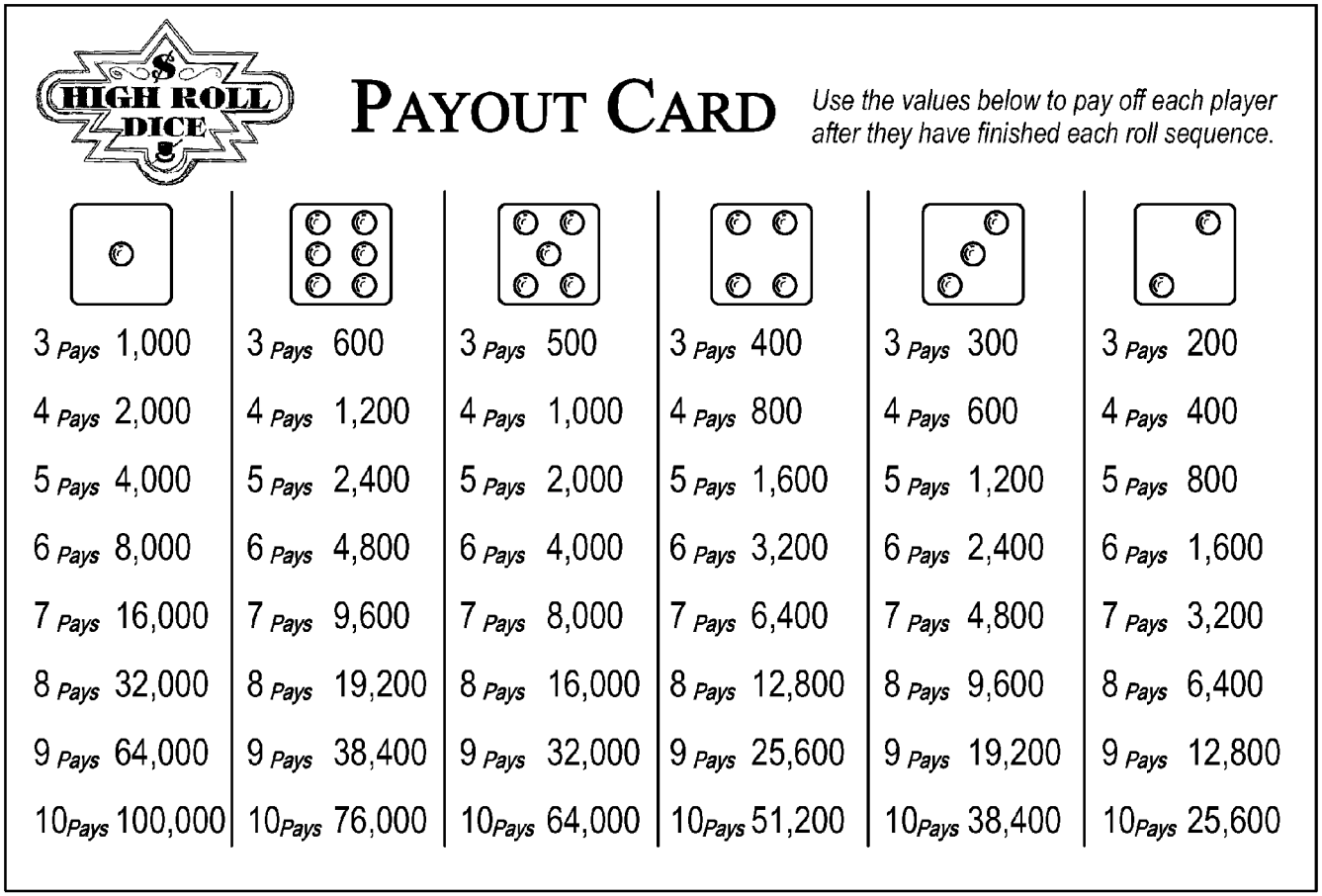
FIG. 5 shows one side of the payout card comprising part of the game apparatus of the present invention.
Figure 6A:
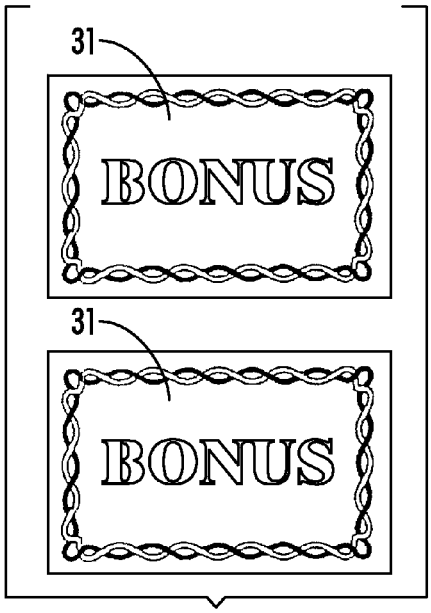
FIGS. 6*a*-6*b* illustrate the first and second sides of the "Bonus" cards comprising part of the game apparatus of the present invention.
Figure 6B:
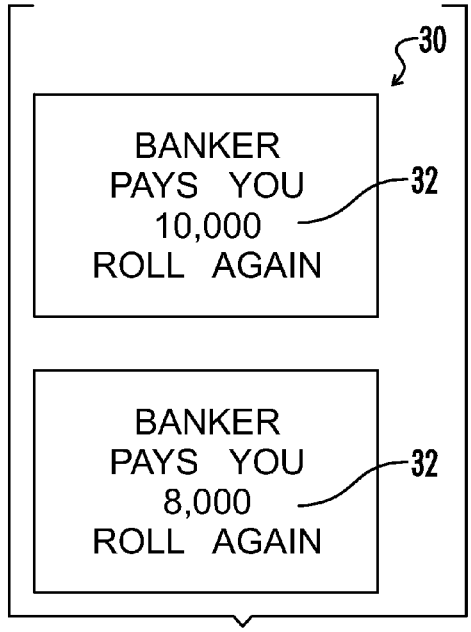
Figure 7:
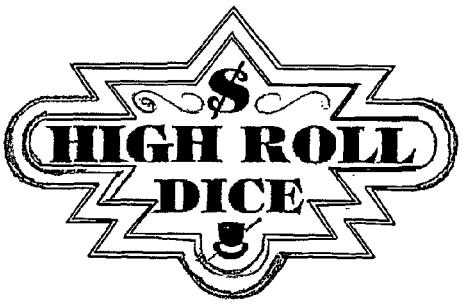
FIG. 7 is a view of the game instructions for use with the game apparatus and method of the present invention.
Figure 9:
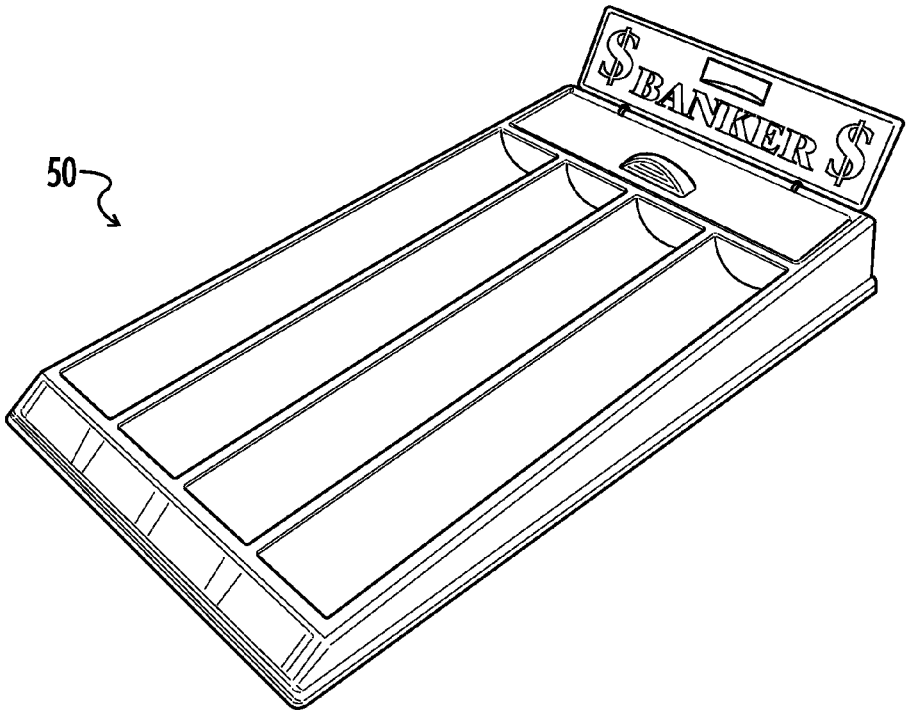
FIG. 9 illustrates a perspective view of an alternative chip box or tray comprising part of the game apparatus of the present invention

Also provided for use with the preferred embodiment of the game, as shown in FIG. 2, are ten dice 20. Although dice 20 may be of any shape, size, and color, preferably they are conventional six-sided or cubical dice having one of the number values 1, 2, 3, 4, 5, and 6 on each face, such value being indicated by one or more dots corresponding to said values. As shown in FIGS. 3 and 4, respectively, the game also includes a larger chip rack or banker's tray 22 having slots in which a plurality of chips 24 such as conventional poker chips used during play of the game are stored, and four smaller chip racks or holders 26 which are used to store and hold the chips of each individual player during play of the game. Tray 22 also may include an area for storing dice 20 and the bonus cards when they are not being used in the game, and may also have a lid attached to secure the dice during storage. See the alternative banker's tray shown in FIG. 9. A score payout card 28, shown in FIG. 5, is also preferably included, which card contains the point values assigned to various dice roll sequences and may be referenced during game play to make it easier to calculate the players pay off after each roll sequence, as will be described in more detail below. A deck of playing cards 30, two examples of which are shown in FIGS. 6*a* and 6*b*, is also provided with the game, which cards have a first side 31 on which the word "Bonus" as well as other ornamental indicia is printed, and a second side 32 containing a bonus point total 33, and appropriate wording such as "House Pays You 9,000 Roll Again" indicating the pay out to such player and the next step in the game or the like. A rule book or instructions 34 summarizing the method of play of the game may also be provided and referenced during setup and play of the game.

During setup of the game, each player is given an empty chip holder 26, and the dice throw box 10 is placed between or in close proximity to all of the players. The "Bonus" cards 30 are then shuffled and placed in a stack in middle section 13 of dice throw box 10 with side 31 facing upwardly. One of the players is selected to serve as the "Banker" for the game, such as by each player throwing one die and the player with the highest number being selected. The Banker takes control of chip rack 22, which should be filled with chips 24. An order of play for the players is also determined, such as the player selected as the Banker going first and then the players taking turns in a clockwise direction, although any agreed-upon order may be used. In the embodiment shown, the game is designed to be played by between two and four players, although a fifth participate could serve as the Banker but not as a player. Of course, the game could be revised to accommodate a larger number of players without coming outside the intended scope of the invention.

In the preferred embodiment of the game illustrated herein, the game is played as described below, continuing until one of the players accumulates a score of 122,000 points, after which such player will be anointed the "winner" of the game; however, each non-winning player will have one last chance to become the "high roll winner" by achieving an even higher overall score than the score achieved by the "winner". Based on such winning score of 122,000 points, each of the individual player chip holders 26 is preferably dimensioned to hold exactly 122,000 points worth of chips, and preferably will have three separate rows or slots, one for holding chips worth 5000 points, one for holding chips worth 1000 points, and one for holding chips worth 100 points. Although not strictly necessary, such arrangement is preferred because the chip holders 26 serve as visual indicators not only of how many points a player has accumulated himself or herself at any point during the game, but also of how many points his or her opponents have accumulated, and therefore how close each player is to winning the game in relation to the other players, which as discussed below adds to the overall strategy of the players throughout the game.

At the start of the game, each player will have zero points. The first player then will grasp all ten of the dice 20 in his or her hands, or if desired in a separate throwing cup, not included, and then throw all ten dice together in section 11 of dice box 10. If one of the dice 20 lands so that it is resting on top of one of the other dice, or is leaning against one of the other dice, the entire roll is void and such player must re-roll all of the dice. Once a proper roll is completed, the results are analyzed to determine if the roll resulted in at least one set of three like kind or more of the dice landing with the same number or suit facing upwardly. If so, such dice are separated from the other dice and placed in one of the score areas or sections 12 or 14 of dice box 10, whichever is closest to said player. If the initial roll of the ten dice resulted in multiple sets of three-of-a-kind dice, the set having the highest point value will normally be selected, while the other set remains in the throwing box with the other non-selected dice. However, the player is free to select any set of three-of-a-kind or more dice of the same suit at this point in the game. Then, the score payout card 28 shown in FIG. 5 as a guide, the banker will determine the value associated with such three like kind or more roll. For example, as shown on score payout card 28, if three 5's are rolled, the roll has a value of 500 points, while if four 6's are rolled, the roll has a value of 1200 points. The player must then decide either to stop rolling and to "bank" such points, at which time the banker will dispense or pay out chips to such player in an amount equal to the number of points accumulated, or alternatively, to roll the remaining dice not placed in score area 12 or 14 again in an attempt to accumulate more points by rolling at least one dice 20 having the same suit as the dice already placed in holding area 12 or 14. If at least one additional dice of the same suit is rolled, each of such additional dice is then placed in scoring area 12 or 14 with those die previously placed in such area, and the player's points for such turn correspondingly increased. As an example, if in an initial roll a player rolls three 5's, which according to score payout card 28 has a value of 500 points, and upon rolling the remaining seven dice a second time two more 5's are rolled, each additional five will double the players' score, so that such player will have 2000 accumulated points, as indicated on score payout card 28, for that turn. Such player must now again decide whether to "bank" the points accumulated, or roll the remaining five dice again to try to accumulate even more points on such turn. If the remaining five dice are rolled a third time and no dice having the same suit as those in score area 12 or 14 are rolled, the players turn is ended, and none of the previously accumulated points in such turn are "banked", and the players score for such turn is zero. In other words, a player must stop while he or she is winning in order for the points accumulated during a turn to count towards his or her point total in the game. The dice are then passed to the next player to roll.

Another possible outcome of a player's initial roll of all ten dice 20 together is that no sets of three like kind or more dice will be rolled. In most other games of which the present inventor is aware, when a desired role is not achieved, such player's turn is ended, and it becomes the next player's turn immediately, or in some cases the player is given a second opportunity to achieve the same result. In the method of play of the present game, however, when on an initial roll of all ten dice in a turn three-of-a-kind or more dice are not rolled, the player then selects the top card from the deck of "Bonus" cards 30. As illustrated in FIG. 6*b*, such "Bonus" card will contain on one side a point total, in the present game preferably equal to between 5000 and 25000 points, which point total will then be awarded to the player in the form of chips 24 distributed by the banker. In addition, such player also then rolls all ten dice 20 in dice box 10 again, after which he or she will analyze the results, looking for three-of-a-kind or more number values, and if present the set having the highest point value will be removed from play and placed in one of the scoring boxes 12 or 14. If not present, a second "Bonus" card is selected, so that the "Bonus" cards may be awarded as many times as necessary until the player rolls three of a kind or more of the same suit, after which play continues in the manner already described.

The players will continue taking turns rolling the dice until one of the players accumulates a point total greater than or equal to 122,000 points, at which point such player will be declared the "winner" of the game. Upon reaching 122,000 points, the winning player may continue his or her turn to try to accumulate and bank the highest winning score possible. A key feature of the preferred game method, however, is that once a player becomes the "winner" at the end of his or her turn, the remaining players will each have a final turn in which to attempt to accumulate an even higher point total than that of the "winner", or until they do not roll a dice having an upwardly facing value equal to that of the dice previously rolled on such players turn, at which point such player has effectively "busted" and can no longer win the game. If one of the remaining players, however, accumulates a point total greater than that of the "winner", such player will be considered the "high roll winner", unless a remaining player can accumulate an even higher total, in which case such remaining player will be declared the "high roll winner". If none of the players can accumulate a point total that is equal or greater than the "winner's" total, the "winner" will also be declared the "high roll winner". Once each player has taken his or her final turn and the "winner" or a "high roll winner" have been determined, the game is over and a new game can be started.

The awarding of both a "winner" and possibly a different "high roll winner" creates an exciting end to the game wherein players may develop different play strategies as the game proceeds, which strategies will in all likelihood vary from game to game. For example, if in a game one player accumulates a substantially larger point total than the other players very quickly, and is close to the winning total of 122000 points, knowing this the other players are more likely to attempt second, third, fourth and even more rolls in a turn in an effort to accumulate points more quickly and catch up to such player, when they might not be so willing to do so earlier in the game or if all of the players have close or similar scores. In addition, it is possible at any point in the game for a player to accumulate large numbers of points in a single turn, such as from a "BONUS" card if no three-of-a-kind dice are rolled on an initial roll, after which such player will still have an opportunity to roll again and accumulate points in the manner described above. In addition, the point totals of the game have also been arranged so that through a combination of rolls and "Bonus" cards, it is possible for a player to achieve a winning score of 122,000 points in a single turn. For example, if a player rolls ten aces or 1's in a single turn, he or she will accumulate 100,000 points, and if initially one or more "Bonus" points are accumulated, a total exceeding 122,000 could be accumulated. While the game is arranged so that accumulation of such large point totals in a single turn is relatively rare, the fact that it is possible, and also that it depends on how risky or daring a particular player is, adds significantly to the excitement and strategy of the game.

It should be evident from the above, therefore, that an important piece of information in determining one's own strategy is where one stands in relation to the other players at any point in the game. This includes knowing approximately how many points the other players have accumulated, which player is in the lead at any given point of the game, and even the risk strategies being employed by the other players. As another example, if all four players are close to accumulating the 122,000 "winner" total, one strategy might be to try to accumulate a total of just under 122,000 points in a turn, so that while one of the other players will likely become the "winner", the player stopping just short of such total will still have one last opportunity to accumulate an even greater number of points and to be declared the "high roll winner", which player is in effect considered the overall winner of the game.

Figure 8:
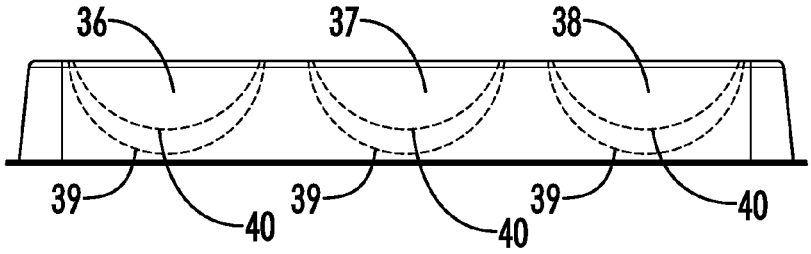
FIG. 8 is a front view of an individual player chip holder used in the game apparatus of the present invention.

As indicated above, in order to make it readily evident to the other players how many points each player has accumulated at any given point in the game, the individual chip holders 26 are sized two hold exactly 122,000 worth of chips. More particularly, each chip holder 26 has three separate rows 36, 37, and 38, with row 36 sized to hold twenty 5000 point chips, row 37 sized to hold twenty 1000 point chips, and row 38 sized to hold twenty 100 point chips. In addition, as shown in FIG. 8, the bottom 39 of rows 36-38 is rounded and fairly uniform, with the exception of a ledge 40 situated along the rear end of each row 36-38, which has a width of approximately a single chip 24. As a result, when a row 36-38 of chips 24 is full, the front nineteen chips will be situated against bottom 39, while the twentieth chip will extend slightly upwardly somewhat from the other chips in the row, making it more readily evident to all of the players that such row is completely filled. A player viewing chip holder 26 in FIG. 8 thus could quickly visually estimate whether the player using such holder is close to or has accumulated a total of 100,000 points in 5000 point chips, 20000 points in 1000 points chips, or 2000 points in 100 point chips, and thus how close such player is to achieving a "winning" score. For example, if a player has only has 90,000 points while the another player has close to 122,000 points, he or she knows that in order to try to catch up, they likely will have to start or continue to take more chances in the form of additional rolls of the dice beyond the first roll in a turn to try to accumulate additional points more quickly.

While the present dice box or board game has been described in detail herein for exemplary purposes, many of the details of such game may be modified while still falling within the basic system or method of play of the game. For example, while the game has been illustrated to be played with ten dice, a greater or lesser number of dice may be used, although depending upon the circumstances other parts of the game may also have to be modified as a result. If, for example, twelve or fifteen dice are used instead of ten, the game may also have to be changed so that the players must achieve at least four-of-a-kind dice, rather than three-of-a-kind as in the embodiment described above, since achieving three-of-a-kind would necessarily occur every time with fifteen dice so that the "Bonus" cards would never be used. Other features such as the scoring payout system and winning score might also have to be modified so that the length of an average game is not unreasonably long or short. Furthermore, if the winning score is changed, the size of the individual player chip holders would also have to be changed to hold exactly the new winning chip total, or even based on the width of the chips used with the game. Of course, at some point there is a maximum number of dice that can reasonably be used in the game, or otherwise it would become too unwieldy to hold and throw the dice as well as to visually discern the various combinations of values when thrown in the dice box. It should be obvious that in any case statistically the probability of achieving a given roll using a given number of six-sided dice can be calculated, and once known the other components of the game can be set or determined based on these probabilities. At the other end of the spectrum, a lesser number of dice could also be utilized in the game while still falling within the scope of the present invention, although again other parts of the game would likely have to be modified to ensure that the game is sufficiently exciting and engaging. The likelihood of achieving a "Bonus" card preferably is fairly low during game play, at least in relation to the likelihood of achieving a specified number of like kind or more dice upon an initial roll of all of the dice. Due to such relative rarity, the point totals associated with the "Bonus" cards may logically be substantially greater on the average than the average result from the dice. Another feature of the "Bonus" cards is that in effect points will be awarded to every player on his or her first roll of the dice, either from achieving three like kind or more of the dice, or from the "Bonus" cards, although such points will not be "banked" until the player requests such action be taken. Other possible changes consistent with the overall scheme of the game would be to use dice having a greater or lesser number of faces other than the standard six-sided dice, or to use a chance determining means such as a spinner in place of the "Bonus" cards to determine ones bonus score.

Since the basic strategy of the game depends upon having a sufficient number of dice or individual dies to first roll a pre-selected initial number of dice with the same number, or identification, to select or predetermine a number to be used as a scoring number by either an individual player or in some cases by all players and since, furthermore, the actual dies bearing such number are then removed from the available playing dies and available for the next roll, with their value accumulated in accordance with some predetermined scoring system, whereupon the individual player then rolls the remaining individual dies and again removes those that come up with the same number and accumulates the total of those with the selected identification number as that of the first removed dice with the total rolled as many times as one wishes, but very importantly interrupting such successive rolling or throwing of dice before no dice with the initial thrown number are rolled, upon the occurrence of which according to the rules of the game, the roller or thrower of the dice on that particular turn will lose all his or her accumulated score, it is necessary in order to achieve a game in which a variety of action is possible and various strategies can be used to use sufficient dice in the game to have a reasonable number of dice such that (a) there is a reasonable likelihood that a minimum number will come up with the same number in an initial roll or throw of the dice and (b) when those are removed from availability for subsequent throws that there still be a reasonable likelihood that the same number will come up again upon a further throw or be thrown again. Otherwise there would be no incentive for the player to throw or roll again or if another was thrown to throw a third time.

Thus there must, as a practical matter, be some minimum number of dices used in the game of the invention. Likewise, there is as a practical matter an upper number of dice usable in the game and a number of dice required to come up with the same number in order to start accumulating a score. If the total number of dice is too low, the odds of coming up with the same number in successive throws of the dice by each player becomes too low and the strategy to win will be always to take only one throw of the dice when one's turn comes up. On the other hand, if such number is too high, it will take too long or too many throws before the odds of coming up with or throwing no such numbers decreases to a point where the player's strategy may be to stop or cease dice throws in any given turn of a player at throwing dice and the game will begin to drag. Likewise, if the number of dies with the number it is necessary to initially throw, which is the same number of dice removed from play after the first throw, is too low the chances of coming up with the same number will be too high in the second and succeeding throws and again the game will drag or lag. As a practical matter, therefore, while the inventor has found that the use of ten six-sided dice in the game is about the optimum number and therefore the preferred number in accordance with the invention, any noted number of dice from about 8 to 12 can be used with good effect and the requirement for a first throw to begin play can be from two to five dice of a kind or with the same number with, as indicated, a preferred or optimum range of ten total playable dice and three like kind or more dice. In each game in accordance with the invention, however, there is a particular combination of these two numbers, i.e. the total dice in the game and the number of dice of a kind in the first throw of a player to begin accumulating points which will be optimum in the usual playing group. This ratio basically determines the strategy which will be established between the players. However, with any given number of dice, the personalities and perceptions of the individual players will determine the actual strategy used by each player. As will be evident, the particular scoring system for the value of each throw can vary, although such scoring system should be reasonably easy to follow and calculate. In addition, the particular value of the bonus cards or even the use of bonus cards at all can be varied in accordance with the broad particular and principles of the game.

As will be evident, the score at which the game will be ended will also be variable depending upon whether it is judged the strategic game can be played and still remain a fast paced game. This will depend basically at least also upon the type of persons who are likely to play. Those parties who enjoy detailed analysis of the specifics of the game as such game proceeds, such as those who may, for example, enjoy a good chess game, may find a higher score which will take longer to reach more fascinating, while the party who would be more likely to enjoy a game of checkers may prefer a lower winning score in order to complete a game more quickly.

As will be also evident from the description set forth above, the score which determines the winner is the score attained upon reaching a set score preferably 122,000 but which could be basically any advanced score provided for by the rules of the game, at least in so far as the game is played without any extra throws of the dice, i.e. the game is played without the use of further dice throws after the initial series will end the basic game. However, in the preferred form or version of the game, there will be one further turn allowed, and the player attaining the highest score becoming the overall winner. In this preferred version of the game, the reaching of the accumulated additive winning score rather than actually ending the game merely provides a reference point in play at which the moves necessary to end play will be begun. Otherwise, there might be no conclusion to the strategic game, and, furthermore, the players would not have an indication point to use for making an estimation near or judgment of how near someone else is to winning and whether they should change their strategy to try to catch up with such party in the lead.

The use of bonus cards may not have at times much effect upon the game, but provides a psychological lift to the player who loses completely on a throw of the dice which might discourage such player and cause him or her to lose interest. The introduction of the bonus cards means that a player who is unlucky at throwing dice always nevertheless wins something and can at times make a significant difference in the ultimate winner of the game. The bonus cards thus also can make a significant contribution. To an even greater extent providing a bonus card with at least something added upon losing an accumulated score tends to have a psychological effect upon the player since they, with the use of bonus cards always in this way win something and are not therefore "wiped out" which can have a beneficial psychological benefit upon the player and particularly a losing player. Even if the bonus is not an addition to the players actual score but merely the privilege of drawing another bonus card with perhaps an addition to his or her score, the psychological effect is likely to be good. Of course, the usual house card score should be sufficient so the drawing player should not feel completely wiped out and such player retains a perception at least of a possible chance to still be "in the running" so to speak.

While the present game is designed to be played by two to four players, different versions of the game such as a travel version or deluxe version following the same basic method of play are also contemplated. It is further contemplated that there will be a tournament version and tournaments for playing such game will be set up, where a plurality of games are played simultaneously and with the winners advancing to play each other until there is a tournament or grand prize winner.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A method of playing a strategic dice game comprising:

(a) providing from 8 to 12 individual dice each having a plurality of unique identifying legends on substantially all flat surfaces, each die being marked on said surfaces with the same identifying legends as each other die, (b) providing a supply of bonus cards each having a bonus point total marked thereon, and providing a supply of game chips each having a designated point value, (c) designating one player as the banker, (d) providing each player with a game chip holder apparatus, said apparatus containing a number of separate storage compartments equal or correlated to the number of game chips of different point values, said compartments together sized to hold a number of game chips having a total point value equal to the winning point value for said game, and each of said separate storage compartments additionally comprising a means for holding the last chip to be placed in said compartment in an elevated position with respect to the other chips in said compartment, providing a visual means for each of the other players to quickly estimate the number of points accumulated by each of the other players at any point during game play;

(e) establishing an order of serial play for a selected group of players by any convenient selection method, (f) each player then in turn according to said established order of play initially rolling all of the dice simultaneously, (g) analyzing the results of said initial roll to determine whether any of said identifying legends was rolled a predetermined minimum number of times, and if said requirement is met selecting one of the qualifying legends as being that player's identifying legend for said turn, but if said requirement is not met assigning one of the bonus cards at random to the player, awarding said player a number of game chips having a point value equal to the bonus point total marked on said bonus card, which game chips are placed in said storage apparatus, and awarding the player another opportunity to roll all of said dice in the same turn to meet said requirement, and repeating this procedure until said requirement is met, (h) counting the number of dice rolled having said selected identifying legend rolled a predetermined minimum number of times, (i) removing from further play in said turn the dice rolled having said selected identifying legend, (j) the player then optionally either banking the awarded points and being awarded a number of chips equal to the awarded points for said roll by said banker, ending said turn, or making a further roll of dice using only the dice remaining in play and again attempting to roll one or more dice having said selected identifying legend, and if successful accumulating additional points in said turn, and then repeating the step of either optionally banking the total awarded points and being awarded a number of chips equal to the total awarded points for said roll, ending said turn, or removing from further play in said turn the dice rolled having said selected identifying legend and rolling the dice remaining in play again, until said player either banks the awarded points or the further roll does not result in one or more dice having said selected identifying legend, in which case said player's turn is ended and all points accumulated in the turn are not banked and the awarded chips in said turn must be returned to the banker, (k) the players continuing to take turns rolling the dice in the initially assigned order until one player accumulates a number of chips equal to said predetermined winning point value derived from players throwing dice hands having an identifying legend selected for that turn, with said player becoming the nominal winner and being allowed to complete said turn, (l) the players upon strategizing whether to make further rolls in addition to an initial roll in each turn viewing the chip holder apparatus of each other player to quickly estimate said player's accumulated point value position in the game relative to said other players.

2. A method of playing a strategic dice game in accordance with claim 1 wherein a total of 9 to 11 dice are used in each initial throw.

3. A method of playing a strategic dice game in accordance with claim 1 wherein ten dice are used in each initial dice throw.

4. A method of playing a strategic dice game in accordance with claim 1 additionally comprising:

(m) after the winning point value is attained by a player, each of the other players being availed a final serial turn to attempt to accumulate an even greater point total than that of the nominal winner, with the player accumulating the greatest point total that exceeds the total score of the nominal winner being declared the grand winner, but if no player accumulates a point total greater than the nominal winner, the nominal winner also being declared the grand winner.

5. A method of playing a strategic dice game in accordance with claim 4 in which every turn results in a player being awarded and having the opportunity to bank points which are added to said player's total score.

* * * * *